US007845917B2

(12) United States Patent
Tateishi et al.

(10) Patent No.: US 7,845,917 B2
(45) Date of Patent: Dec. 7, 2010

(54) ELECTRIC BLOWER

(75) Inventors: Shiro Tateishi, Fukui (JP); Yasuo Nozaki, Aichi (JP); Akira Yamaguchi, Fukui (JP)

(73) Assignee: Panasonic Corporation, Osaka (JP)

( * ) Notice: Subject to any disclaimer, the term of this patent is extended or adjusted under 35 U.S.C. 154(b) by 337 days.

(21) Appl. No.: 11/577,549

(22) PCT Filed: Oct. 31, 2005

(86) PCT No.: PCT/JP2005/019972

§ 371 (c)(1),
(2), (4) Date: Apr. 19, 2007

(87) PCT Pub. No.: WO2006/049115

PCT Pub. Date: May 11, 2006

(65) Prior Publication Data

US 2008/0193305 A1 Aug. 14, 2008

(30) Foreign Application Priority Data

Nov. 4, 2004 (JP) ..... 2004-320217

(51) Int. Cl.
*F04B 39/02* (2006.01)

(52) U.S. Cl. ..... 417/366; 415/206; 415/211.2

(58) Field of Classification Search ..... 417/366, 417/423.14; 415/211.2, 212.1, 206
See application file for complete search history.

(56) References Cited

U.S. PATENT DOCUMENTS 4,231,221 A * 11/1980 Mathner et al. ..... 60/319
D533,936 S * 12/2006 Tateishi et al. ..... D23/411
2003/0147746 A1* 8/2003 Poon et al. ..... 415/208.2
2004/0123482 A1* 7/2004 Tokuda et al. ..... 34/90

FOREIGN PATENT DOCUMENTS

| | | | |
|---|---|---|---|
| JP | 03-023399 | | 1/1991 |
| JP | 06-1000195 | B2 | 12/1994 |
| JP | 10-026099 | A | 1/1998 |
| JP | 2001-012395 | A | 1/2001 |
| JP | 2001-271794 | A | 10/2001 |
| JP | 2003-135319 | A | 5/2003 |
| JP | 2004-169592 | A | 6/2004 |
| JP | 2004169592 | A * | 6/2004 |

OTHER PUBLICATIONS

International Search Report for Application PCT/JP2005/019972, dated Jan. 24, 2006.

* cited by examiner

*Primary Examiner*—Devon C Kramer
*Assistant Examiner*—Todd D Jacobs
(74) *Attorney, Agent, or Firm*—RatnerPrestia

(57) ABSTRACT

An electric blower includes a motor having a stator on which field windings are wound, a rotor facing the stator, and a bracket covering the stator and the rotor. The electric blower further includes a fan mounted to a shaft coupled to the rotor, and an air guide having a diffuser provided to the outer circumference of the fan and formed of a plurality of stationary blades adjacent to each other. The electric blower still includes a fan case having openings at its outer circumference for discharging a part of the air having passed the diffuser to the outside, and protrusions having a brim for covering a part of the openings. The foregoing structure allows the air blower to cool the motor with airflow generated by the fan.

3 Claims, 6 Drawing Sheets

ELECTRIC BLOWER

THIS APPLICATION IS A U.S. NATIONAL PHASE APPLICATION OF PCT INTERNATIONAL APPLICATION PCT/JP2005/019972.

TECHNICAL FIELD

The present invention relates to electric blowers to be employed in electric vacuum cleaners and so on.

BACKGROUND ART

First, a structure of an electric blower to be used in an electric vacuum cleaner commonly used is described briefly hereinafter with reference to FIG. 5. In FIG. 5, stator 102 is formed of field-magnetic core 103 on which field windings 113 are wound. Armature windings 108 are wound on armature core 107, which is coupled to shaft 106. Armature core 107, armature windings 108 and shaft 106 form rotor 105, which is rotatable because shaft 106 is supported by bearing 110. Shaft 106 is equipped with commutator 109.

Motor-side bracket 112 fixes stator 102, and it also fixes brush holder 114 with screw 115. Brush holder 114 holds a pair of carbon brushes (not shown), which touches commutator 109. Motor 116 is thus formed.

Bracket 112 is equipped with exhaust port 120, and shaft 106 is equipped with centrifugal fan 117, of which outer circumference is provided with air guide 118 forming an air duct. Air guide 118 is formed of diffuser 121, flow changer 122 for guiding airflow to the rear of air guide 118, and return path 123. Diffuser 121 includes a plurality of paths formed of stationary blades 129 of which surfaces are adjacent to each other. Bracket 111 and fan case 119 are prepared on the fan side. Fan case 119 includes intake port 125 for sucking air. Conventional electric blower 101 is thus constructed.

In the construction discussed above, motor 116 is powered from an external source, an armature current runs to armature windings 108 via the carbon brushes (not shown) and commutator 109, and a field current runs through field windings 113 wound on stator 102. The field current prompts field core 103 to produce magnetic flux, and force is generated between the magnetic flux and the armature current running through armature windings 108, so that rotor 105 is rotated.

Rotation of rotor 105 prompts centrifugal fan 117 provided to shaft 106 of rotor 105 to rotate, then the air in centrifugal fan 117 is speeded up and runs through diffuser 121 of air guide 118, where the air is slowed down, then the air enters into flow changer 122, which changes the flow direction of the air by 180°, then the air runs toward motor 116 via return path 123. The air then cools rotor 105, stator 102, and the carbon brushes before the air is exhausted from exhaust port 120 of bracket 112.

The foregoing structure of the conventional electric blower cannot meet the enhancement of efficiency needed for electric blowers to satisfy the higher suction power of the recent home-use vacuum cleaner. Another prior art developed for compensating for the insufficient part of the foregoing structure is disclosed, e.g. in Unexamined Japanese Patent Publication No. 2001-271794. This instance is described hereinafter with reference to FIG. 6, in which similar elements to those in FIG. 5 have the same reference marks and the descriptions thereof are omitted here.

Electric blower 201 shown in FIG. 6 has outwardly falling tabs 136 formed by cutting and raising the upper side of each one of slits 126 outwardly, which slits 126 are provided to the outer circumference of fan case 119, thereby forming openings. Through the openings, the air having passed diffuser 121 is discharged in part to the outside, so that the efficiency of electric blower 201 improves.

However, since the foregoing electric blower has tabs 136 which outwardly falls along the direction from the end of sucking side (upper side of the slit) of slit 126, placed to the outer circumference of fan case 119, to the opposite end (lower side of the slit) to the sucking side, and the openings formed by tabs 136 are opened opposite to a sucking inlet of fan case 119, the openings cannot be large enough to discharge a part of the air having passed diffuser 122 to the outside. As a result, this structure also limits the improvement of the efficiency of the electric blower to a certain degree.

DISCLOSURE OF INVENTION

An electric blower of the present invention comprises the following elements:

- a motor including a stator on which field windings are wound, a rotor facing the stator, and a bracket covering the stator and the rotor;
- a fan mounted to a shaft coupled to the rotor;
- an air guide including a diffuser formed of a plurality of stationary blades adjacent to each other, and which diffuser is provided to an outer circumference of the fan;
- a fan case for covering the fan and including openings at its outer circumference for discharging parts of air having passed the diffuser to the outside; and
- protrusions having brims for covering parts of the openings.

The foregoing structure allows the airflow generated by the fan to cool the motor.

The electric blower of the present invention includes the openings for discharging the air having passed the diffuser to the outside in part, and the protrusions having brims for covering parts of the openings. This structure allows the openings to be large enough to discharge parts of the air having passed the diffuser to the outside.

DESCRIPTION OF REFERENCE MARKS

Figure 1:
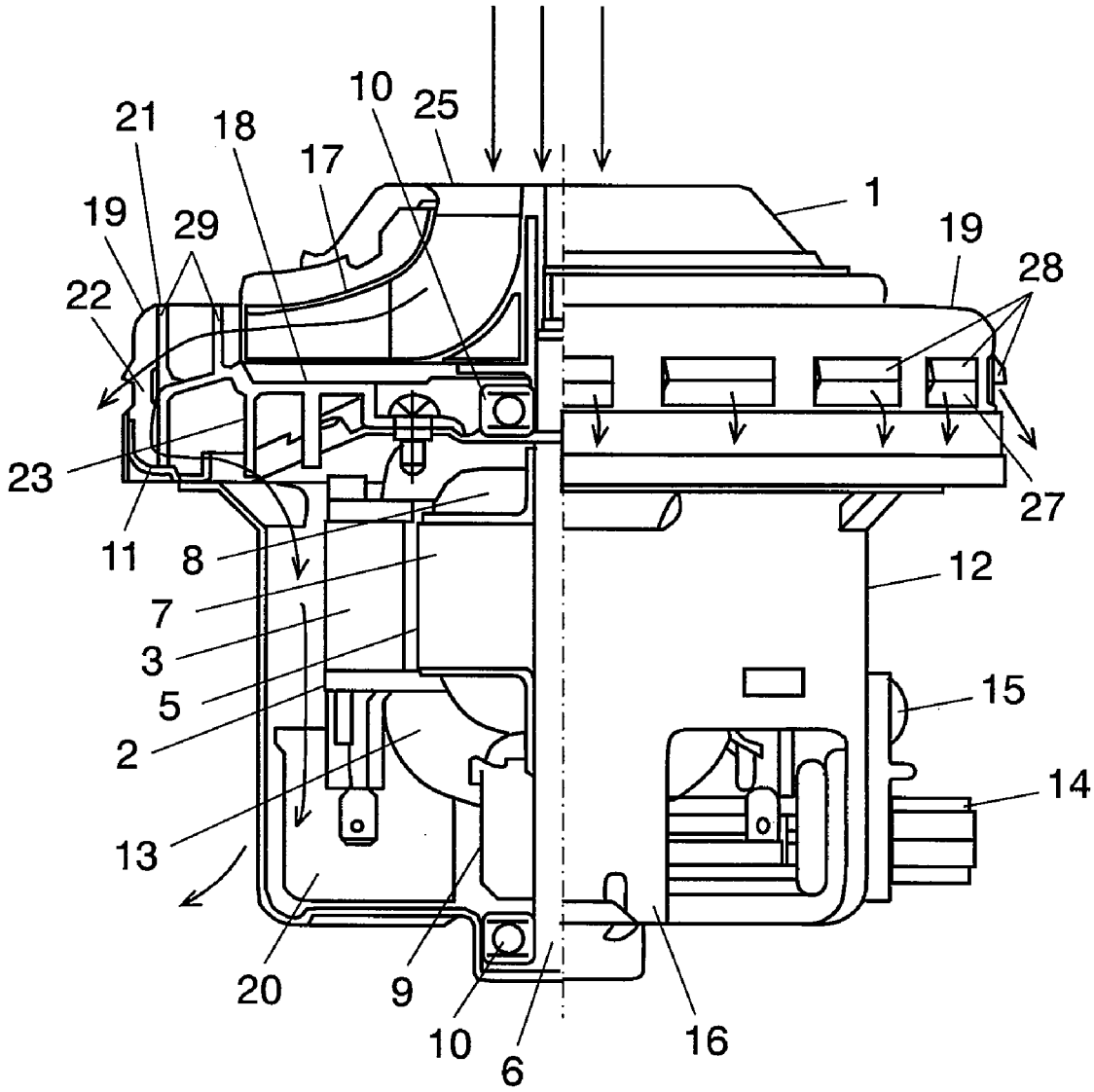
FIG. 1 shows a semi-sectional view of an electric blower in accordance with a first embodiment of the present invention.

1 electric blower
2 stator
3 field core
5 rotor

6 shaft
7 armature core
8 armature winding
9 commutator
10 bearing
11 fan-side bracket
12 motor-side bracket
13 field winding
14 brush holder
15 screw
16 motor
17 fan
18 air guide
19 fan case
20 exhaust port
21 diffuser
22 flow changer
23 return path
25 intake port
27 opening
28 protrusion having a brim
29 stationary blade
30 brim

DESCRIPTION OF PREFERRED EMBODIMENTS

An electric blower of the present invention comprises the following elements:

- a motor including a stator on which field windings are wound, a rotor facing the stator, and a bracket covering the stator and the rotor;
- a fan mounted to a shaft coupled to the rotor;
- an air guide including a diffuser formed of a plurality of stationary blades adjacent to each other, and which diffuser is provided to an outer circumference of the fan and;
- a fan case for covering the fan and including openings for discharging parts of the air having passed the diffuser to the outside; and
- protrusions having brims covering the openings in part.

The foregoing structure allows the airflow generated by the fan to cool the motor, and improves the efficiency of the electric blower.

The width of the brim preferably tapers along the rotary direction of the fan, so that the air slowed down at the diffuser can be discharged in part to the outside efficiently. As a result, the efficiency of the electric blower can be further improved.

The brim preferably covers 30-75% of the entire area of the opening, so that the air quantity is distributed in good balance for cooling the motor and for being discharged from the outer circumference of the fan case. As a result, the motor can be fully cooled while the electric blower maintains the high efficiency.

Exemplary embodiments of the present invention are demonstrated hereinafter with reference to the accompanying drawings.

Exemplary Embodiment 1

FIG. 1 shows a semi-sectional view of an electric blower in accordance with the first embodiment of the present invention. In FIG. 1, stator 2 includes field core 3 on which field windings 13 are wound. Armature core 7 includes armature windings 8 wound thereon, and is coupled to shaft 6. Armature core 7, windings 8 and shaft 6 form rotor 5, which is rotatable because the both the ends of shaft 6 are supported by bearings 10. Shaft 6 is equipped with commutator 9.

Motor-side bracket 12 fixes stator 2, and also fixes brush-holder 14 with screw 15. Brush holder 14 holds a pair of carbon brushes (not shown), which touches commutator 9. Motor 16 is thus formed. Bracket 12 includes exhaust port 20.

Fan 17 is mounted to shaft 6, and air guide 18 is provided to the outer circumference of fan 17 for forming an airflow path. Air guide 18 includes diffuser 21, flow changer 22 for guiding the airflow to the rear of air guide 18, and return path 23. Diffuser 21 has a plurality of paths formed by stationary blades 29 of which surfaces are adjacent to each other. Fan-side bracket 11 and fan case 19 are provided to the fan. Fan case 19 includes intake port 25 for sucking air. Electric blower 1 of the present invention is thus formed.

Supplying power to motor 16 prompts an armature current to run through armature windings 8 via the carbon brushes (not shown) and commutator 9, and a field current to run through field windings 13 of stator 2. The field current prompts field core 3 to produce magnetic flux, and force is generated between the magnetic flux and the armature current running through armature windings 8, so that rotor 5 is rotated.

Rotation of rotor 5 prompts fan 17 provided to shaft 6 of rotor 5 to rotate, then the air in fan 17 is speeded up and runs through diffuser 21 of air guide 18, where the air is slowed down, then the air enters into flow changer 22, which discharges the air in part to the outside from openings 27 and also changes a flow direction of the remaining air by 180°, then the remaining air runs toward motor 16 via return path 23. The remaining air then cools rotor 5, stator 2, and the carbon brushes before it is discharged from exhaust port 20 of bracket 12.

Openings 27 provided on the outer circumference of fan case 19 are detailed hereinafter. On the upper section of each one of opening 27, protrusion 28 having a brim (shaping like a cap's peak) covering opening 27 in part.

Opening 27 along the circumferential direction has approx. the same width as that of the path along the circumferential direction just before entering into flow changer 22, and the path has been formed by stationary blades 29 adjacent to each other. Openings 27 and protrusions 28 having the brim are placed approx. on an extension of the path so that exhaust air can be efficiently discharged. The arrow marks in FIG. 1 indicate the flow of air sucked from intake port 25.

Next, operation of the foregoing electric blower in accordance with this first embodiment is demonstrated hereinafter. Supplying power to motor 16 prompts rotor 5 to rotate, and then fan 17 spins, which generates airflow passing through diffuser 21 of air guide 18. Parts of the airflow are discharged from openings 27 to the outside. The remaining airflow is changed its direction by 180° at flow changer 22 and guided to the motor section.

In this embodiment, a plurality of openings 27 provided on the outer circumference of fan case 19 and protrusions 28 having brims each of which covers opening 27 in part are placed in a highly efficient manner on the outer rim of diffuser 21, so that the air in part hits protrusions 28 having the brims before being discharged from openings 27.

Figure 5:
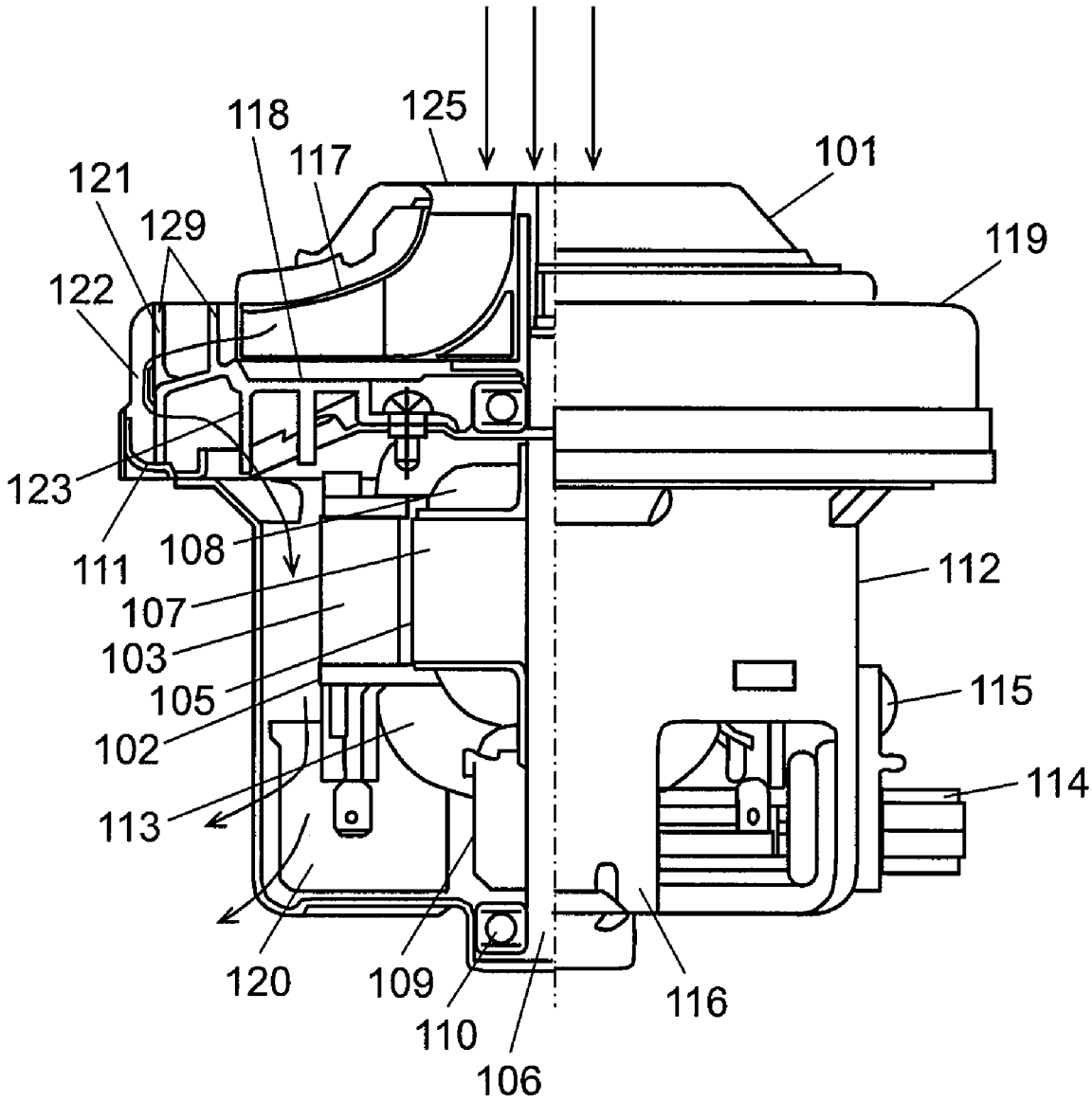
FIG. 5 PRIOR ART
FIG. 5 shows a semi-sectional view of a conventional electric blower.
Figure 6:
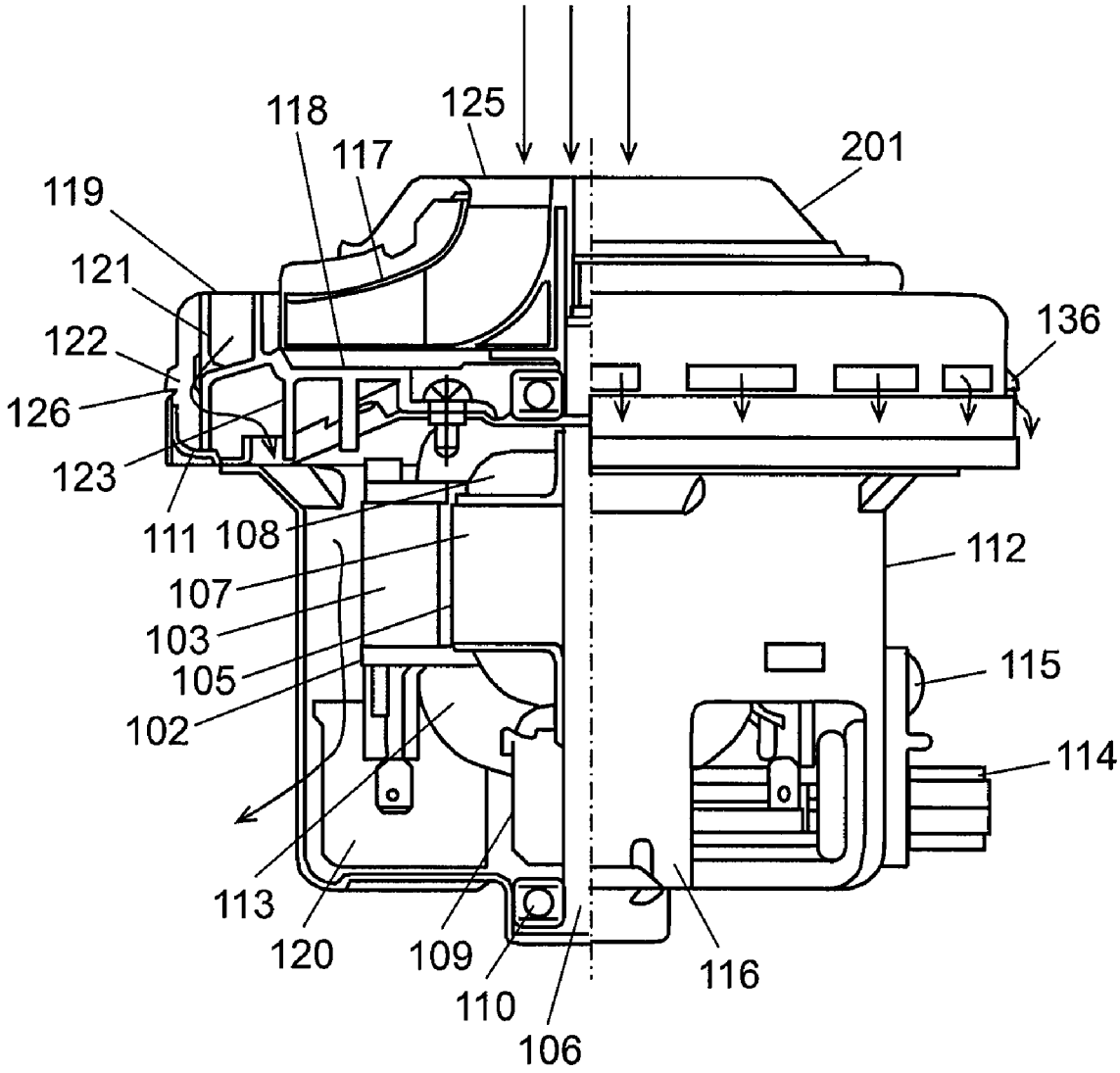
FIG. 6 PRIOR ART
FIG. 6 shows a semi-sectional view of another conventional electric blower.

In other words, the electric blower in accordance with this embodiment includes protrusions 28 having the brims, and each one of protrusions 28 covers not the entire but a part of the area of each one of the openings, while the conventional electric blower shown in FIG. 6 includes outwardly falling tabs 136 which cover almost the entire area of respective openings, thereby forming slits 126 as illustrated in FIG. 6. The electric blower in accordance with this first embodiment allows discharging parts of the air having passed diffuser 21 from openings 27 to the outside more smoothly than the conventional ones shown in FIGS. 5 and 6. As a result, an efficient electric blower, which can reduce the impact loss of the air at openings 27, is obtainable.

Exemplary Embodiment 2

Figure 2:
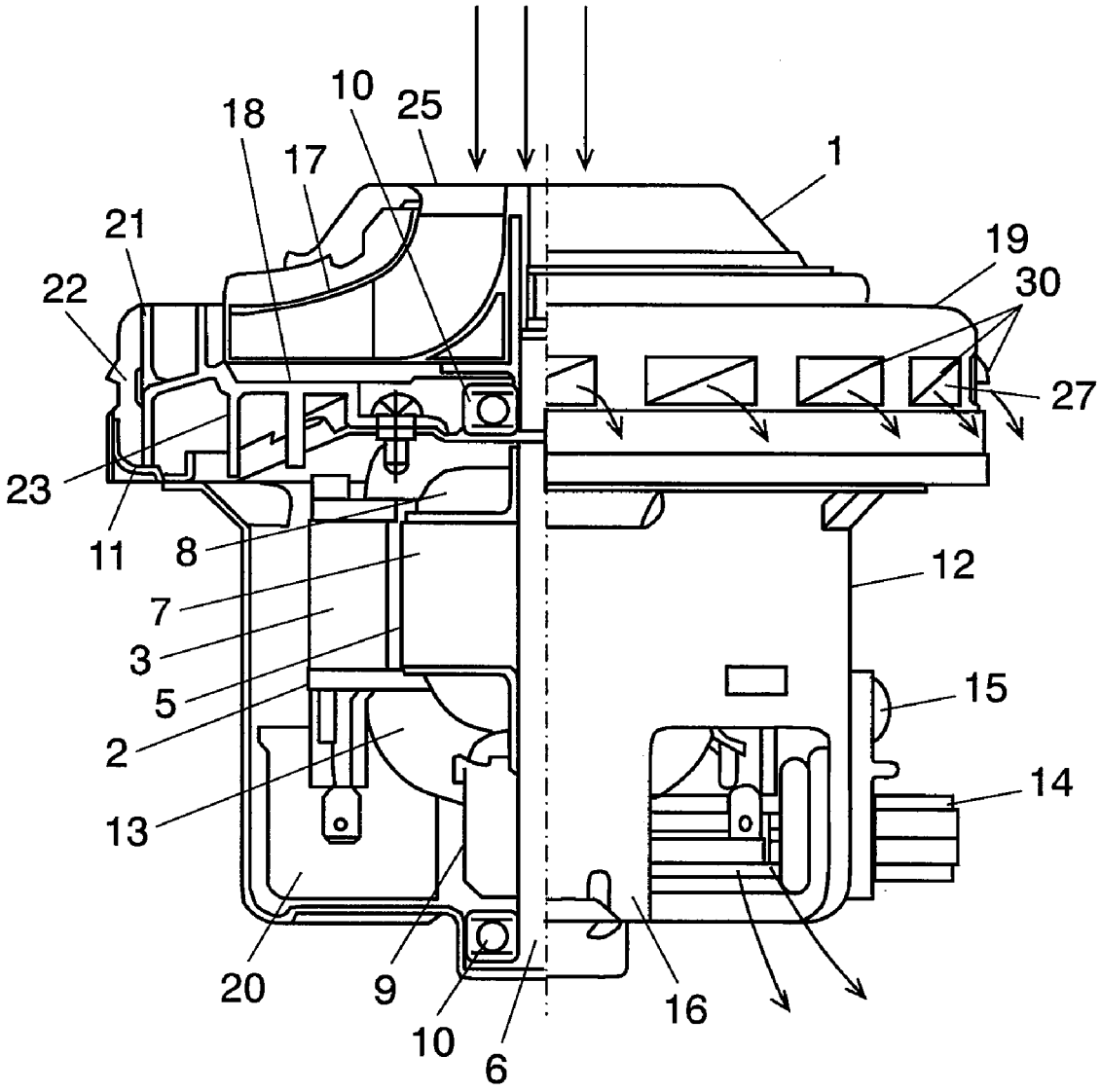
FIG. 2 shows a semi-sectional view of an electric blower in accordance with a second embodiment of the present invention.

FIG. 2 shows a semi-sectional view of an electric blower in accordance with the second embodiment of the present invention. In FIG. 2, similar elements to those used in the first embodiment have the same reference marks, and the descriptions thereof are omitted here. Respective openings 27 of fan case 19 are partially covered with brims 30 each of which width tapers along the rotary direction of fan 17. The arrow marks in FIG. 2 indicate the airflow sucked into intake port 25.

Foregoing electric blower 1 in accordance with the second embodiment operates in the following manner: first, when motor 16 is powered, rotor 5 starts spinning, which entails fan 17 to rotate. Rotation of fan 17 generates airflow which passes through diffuser 21 of air guide 18, and the air is partially discharged to the outside directly.

The remaining air is changed its direction by 180° by flow changer 22, where bend loss increases; however, respective brims 30 provided to respective openings 27 prepared on the outer circumference of fan case 19 taper their widths along the rotary direction of fan 17, so that the air having passed diffuser 21 is partially discharged to the outside smoothly, thereby reducing impact loss of the air at openings 27.

The foregoing electric blower in accordance with the second embodiment allows openings 27 provided on the outer circumference of fan case 19 to further reduce the impact loss of the air, so that efficient electric blower 1 is obtainable.

Exemplary Embodiment 3

Figure 3:
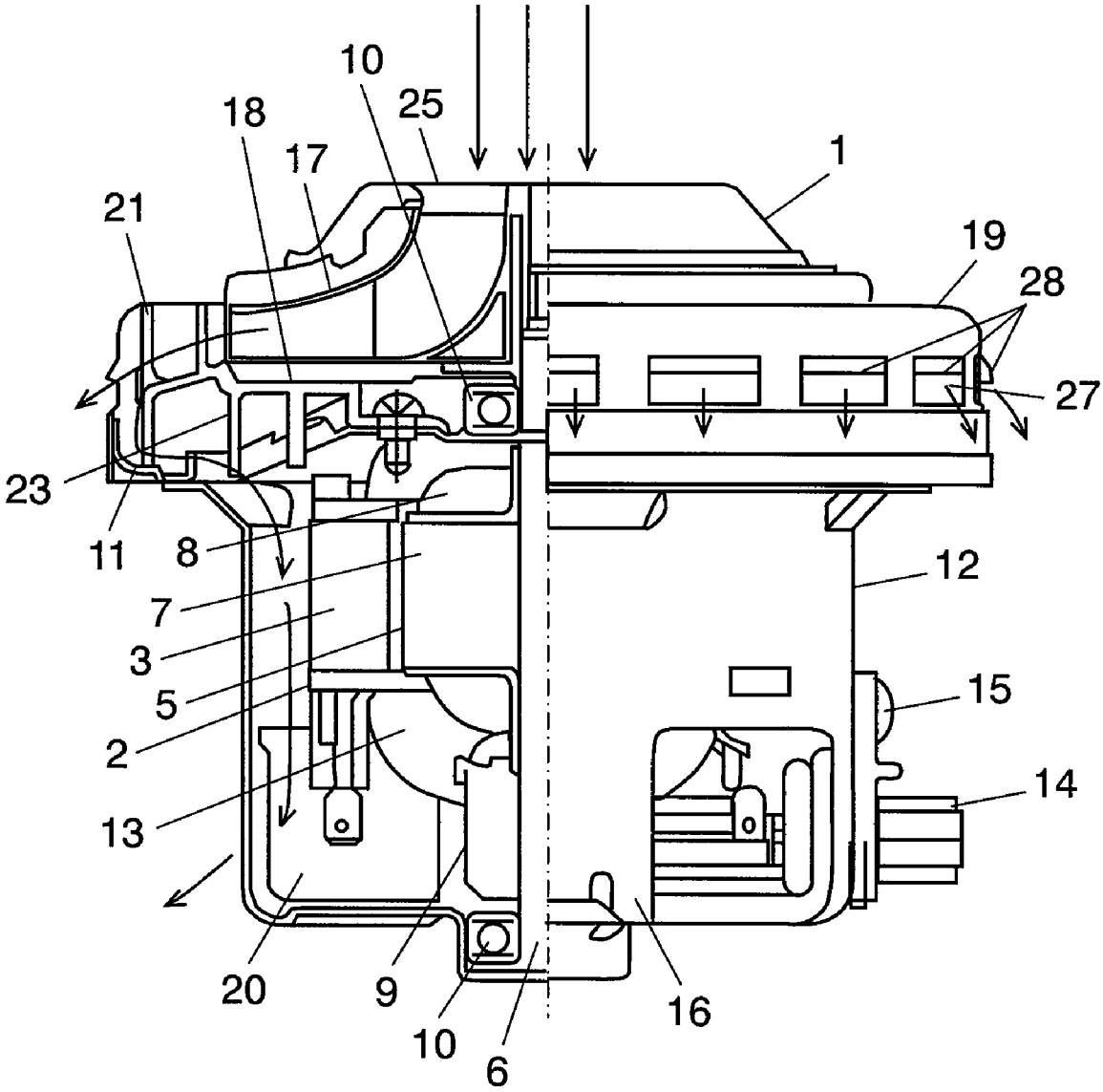
FIG. 3 shows a semi-sectional view of an electric blower in accordance with a third embodiment of the present invention.

FIG. 3 shows a semi-sectional view of an electric blower in accordance with the third embodiment of the present invention. In FIG. 3, similar elements to those used in the first embodiment have the same reference marks, and the descriptions thereof are omitted here. In FIG. 3, openings 27 are provided on the outer circumference of fan case 19, and each one of openings 27 is provided with protrusion 28 having a brim.

This third embodiment differs from the first one in the covering ratio of the opening, namely, protrusion 28 having the brim covers opening 27 by not less than 30% and not greater than 75% (inclusive both the ends).

Foregoing electric blower 1 in accordance with the third embodiment operates this way. When motor 16 is powered, rotor 5 starts spinning, which entails fan 17 to rotate. Rotation of fan 17 generates airflow which passes through diffuser 21 of air guide 18, and the air is partially discharged to the outside directly.

Discharge of the air in part from fan case 19 to the outside allows electric blower 1 to work more efficiently; however, the air quantity for cooling motor 16 decreases, so that the temperature of blower 1 increases.

Figure 4:
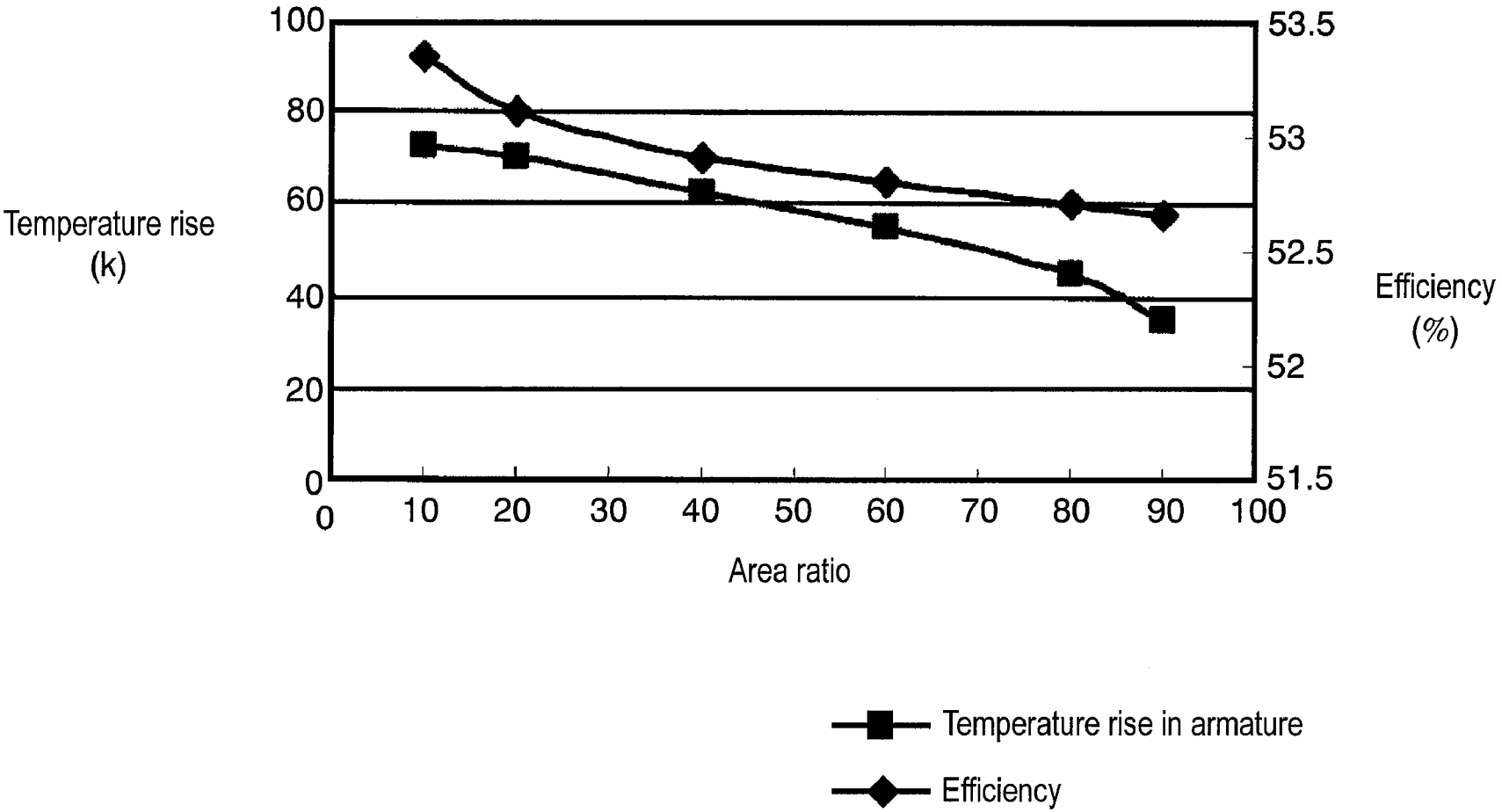
FIG. 4 shows the characteristics illustrating the relation between the ratio of the entire area of the opening vs. an area covered by the protrusion having the brim and a temperature rise of the armature windings, and the characteristics illustrating the relation between the ratio of the entire area of the opening vs. an area covered by the protrusion having the brim and the efficiency of the electric blower.

FIG. 4 shows the characteristics illustrating the relation between the ratio of the entire area of the opening vs. an area covered by the protrusion having the brim and a temperature rise of the armature windings, and the characteristics illustrating the relation between the ratio of the entire area of the opening vs. an area covered by the protrusion having the brim and the efficiency of the electric blower. FIG. 4 tells that when the ratio becomes not greater than 25%, the temperature rise of armature windings 8 exceeds 80K, so that there is worry that too much heat could be generated. On the other hand, the ratio over 80% will lower the advantage of efficiency improvement of blower 1.

In this third embodiment, the foregoing area ratio is set between 30% and 75% (inclusive both the ends), namely, protrusion 28 having the brim covers the entire area of each one of openings 27 at the foregoing ratio. This ratio allows distributing the air in a good balance between the air quantity for cooling motor 16 and the air quantity for being discharged from the outer circumference of fan case 19. Thus this third embodiment proves that motor 16 is cooled enough while electric blower 1 can be improved its efficiency to the maximum extent. As a result, efficient and reliable electric blower 1 is obtainable.

INDUSTRIAL APPLICABILITY

An electric blower of the present invention allows cooling its motor sufficiently while it can improve its own efficiency, so that the blower is useful not only for a home-use vacuum cleaner but also an industrial-use vacuum cleaner.

The invention claimed is:

1. An electric blower comprising:

a motor including a stator on which a field winding is wound, a rotor facing the stator, and a bracket covering the stator and the rotor;

a fan mounted to a shaft coupled to the rotor;

an air guide including a diffuser provided to an outer circumference of the fan and formed of a plurality of stationary blades adjacent to each other;

a fan case for covering the fan and including an opening at an outer circumference thereof for discharging a part of air having passed the diffuser to outside of the fan case; and a protrusion having a brim for covering a first portion of the opening, a second portion of the opening uncovered by the brim, wherein the first portion of the opening is not greater than 75% of an entire area of the opening in a radial direction of the fan, wherein an axial length of the brim tapers from a first circumferential end of the opening all the way to a second circumferential end of the opening, and wherein the air blower cools the motor with airflow generated by the fan.

2. The electric blower of claim 1, wherein the first portion of the opening covered by the brim is not less than 30% of the entire area of the opening in the radial direction of the fan.

3. An electric blower comprising:

a motor including a stator on which a field winding is wound, a rotor facing the stator, and a bracket covering the stator and the rotor;

a fan mounted to a shaft coupled to the rotor;

an air guide including a diffuser provided to an outer circumference of the fan and formed of a plurality of stationary blades adjacent to each other;

a fan case for covering the fan and including an opening at an outer circumference thereof for discharging a part of air having passed the diffuser to outside of the fan case, the opening having a length in the circumferential direction of the fan; and a protrusion having a brim, an axial length of the brim being tapered along the entire circumferential length of the opening, wherein the air blower cools the motor with airflow generated by the fan.

* * * * *

UNITED STATES PATENT AND TRADEMARK OFFICE

CERTIFICATE OF CORRECTION

PATENT NO. : 7,845,917 B2
APPLICATION NO. : 11/577549
DATED : December 7, 2010
INVENTOR(S) : Shiro Tateishi et al.

It is certified that error appears in the above-identified patent and that said Letters Patent is hereby corrected as shown below:

On the Title Page, FIELD [56], References Cited, FOREIGN PATENT DOCUMENTS:
"JP 06-1000195 B2" should read --JP 06-100195 B2--

On the Title Page, FIELD [56], References Cited, FOREIGN PATENT DOCUMENTS:
Please delete duplicate reference "JP 2004169592".

Signed and Sealed this
Fifteenth Day of March, 2011

David J. Kappos

David J. Kappos
*Director of the United States Patent and Trademark Office*